US011478059B2

(12) United States Patent
Xu

(10) Patent No.: US 11,478,059 B2
(45) Date of Patent: Oct. 25, 2022

(54) CONTAINER FOR A ROD-SHAPED MATERIAL

(71) Applicant: ALBEA PLASTIC METALLIZING TECHNOLOGIES (SHANGHAI) CO., LTD., Shanghai (CN)

(72) Inventor: Bo Xu, Shanghai (CN)

(73) Assignee: ALBEA PLASTIC METALLIZING TECHNOLOGIES (SHAGHAI) CO., LTD., Shanghai (CN)

( * ) Notice: Subject to any disclaimer, the term of this patent is extended or adjusted under 35 U.S.C. 154(b) by 0 days.

(21) Appl. No.: 16/273,089

(22) Filed: Feb. 11, 2019

(65) Prior Publication Data

US 2019/0246768 A1 Aug. 15, 2019

(30) Foreign Application Priority Data

Feb. 9, 2018 (CN) ..... 201810141023.2

(51) Int. Cl.
*A45D 40/06* (2006.01)
*A45D 40/12* (2006.01)
*A45D 40/00* (2006.01)

(52) U.S. Cl.
CPC ..... *A45D 40/06* (2013.01); *A45D 40/12* (2013.01); *A45D 2040/0031* (2013.01)

(58) Field of Classification Search
CPC ..... A45D 40/04; A45D 40/06
(Continued)

(56) References Cited

U.S. PATENT DOCUMENTS 5,186,561 A * 2/1993 Ackermann ..... A45D 40/06 401/194
6,139,208 A * 10/2000 Monin-Bareil ..... A45D 40/06 401/55

(Continued)

FOREIGN PATENT DOCUMENTS

CN 201438890 U 4/2010
FR 2891121 9/2005
WO WO02087385 11/2002

*Primary Examiner* — David P Angwin
*Assistant Examiner* — Bradley S Oliver
(74) *Attorney, Agent, or Firm* — CRGO Global; Steven M. Greenberg

(57) ABSTRACT

A container for a rod-shaped material, comprising: an inner cylinder body having at least one longitudinal through hole formed in a side wall of the inner cylinder body; an outer cylinder body having at least one spiral groove formed on an inner wall of the outer cylinder body; and a support cylinder body for supporting the rod-shaped material, an outer wall of the support cylinder body having at least one convex column; wherein the inner cylinder body is accommodated in the outer cylinder body and rotatable relative to the outer cylinder body, the support cylinder body is accommodated in the inner cylinder body, the convex column is inserted into the longitudinal through hole and the spiral groove, such that the convex column moves along the spiral groove when the inner cylinder body rotates relative to the outer cylinder body; wherein at least one elastic pad and at least one elastic sheet are formed between the inner cylinder body and the outer cylinder body, the elastic pad is floatingly arranged in a radial direction of the inner cylinder body or the outer cylinder body, and the elastic sheet is arranged in a circumferential direction of the inner cylinder body or the outer cylinder body.

14 Claims, 7 Drawing Sheets

(58) Field of Classification Search
USPC ..... 401/78
See application file for complete search history.

(56) References Cited

U.S. PATENT DOCUMENTS

| | | | | |
|---|---|---|---|---|
| 7,112,002 | B2 * | 9/2006 | Susini | A45D 40/06 401/80 |
| 2007/0059088 | A1 * | 3/2007 | Chan | A45D 40/06 401/75 |

* cited by examiner

CONTAINER FOR A ROD-SHAPED MATERIAL

CROSS REFERENCE TO RELATED APPLICATIONS

This application claims priority under 35 U.S.C. § 119(a) to Chinese Patent Application Number 2018101410232, filed Feb. 9, 2018, the entire teachings of which are incorporated herein by reference.

BACKGROUND OF THE INVENTION

Technical Field

The embodiments of the present disclosure relate to a container for a rod-shaped material, and more particularly, to a container for an applicable rod-shaped material such as a lipstick, a lip balm and the like.

Background

A container for a rod-shaped material, such as a lipstick tube, typically includes concentrically disposed inner cylinder body, outer cylinder body, and support cylinder body. The inner cylinder body is rotatably disposed in the outer cylinder body, and the support cylinder body supports a rod-shaped lipstick and is slidably disposed in the inner cylinder body. In use, a user rotates a base portion of the lipstick tube to make the inner cylinder body rotate relative to the outer cylinder body. At this time, according to different rotation directions, the support cylinder body can carry the lipstick to rise or fall in the lipstick tube to make the lipstick exposed from or retracted into the lipstick tube. Typically, the lipstick tube also includes a decorative outer casing and a protective cover.

For cosmetic users, not only the quality of the cosmetics itself affects the user's experience and purchase choice, but also the quality and user experience of the cosmetic containers greatly affect the user's recognition of the products. For a lipstick tube, in addition to the quality of the lipstick itself, the smoothness of spin-in and spin-out of the lipstick also greatly affects the user's evaluation of the product quality and the final purchase choice. Generally, the torque to rotate the inner cylinder body and the outer cylinder body relative to each other should not be too large or too small. Therefore, how to control the torque of the relative rotation of the inner cylinder body and the outer cylinder body to make the inner cylinder body smoothly rotate relative to the outer cylinder body has been always a subject of constant research by lipstick tube manufacturers.

SUMMARY

The embodiments of the present disclosure propose a container for a rod-shaped material such as a lipstick, which can better control the torque of the relative rotation of the inner cylinder body and the outer cylinder body, make the inner cylinder body smoothly rotate relative to the outer cylinder body, and improve the user experience.

A container for a rod-shaped material according to the embodiments of the present disclosure comprises: an inner cylinder body having at least one longitudinal through hole formed in a side wall of the inner cylinder body; an outer cylinder body having at least one spiral groove formed on an inner wall of the outer cylinder body; and a support cylinder body for supporting a rod-shaped material, an outer wall of the support cylinder body having at least one convex column; wherein the inner cylinder body is accommodated in the outer cylinder body and rotatable relative to the outer cylinder body, the support cylinder body is accommodated in the inner cylinder body, the convex column is inserted into the longitudinal through hole and the spiral groove, such that the convex column moves along the spiral groove when the inner cylinder body rotates relative to the outer cylinder body; wherein at least one elastic pad and at least one elastic sheet are formed between the inner cylinder body and the outer cylinder body, the elastic pad is floatingly arranged in a radial direction of the inner cylinder body or the outer cylinder body, and the elastic sheet is arranged in a circumferential direction of the inner cylinder body or the outer cylinder body.

According to an embodiment of the present disclosure, the elastic pad and the elastic sheet are both formed on an outer wall of the inner cylinder body.

According to an embodiment of the present disclosure, a distance between an outer end portion of the elastic sheet in the radial direction and a central axis of the inner cylindrical body is greater than a distance between an outer end portion of the elastic pad in the radial direction and the central axis of the inner cylinder body.

According to an embodiment of the present disclosure, the distance between the outer end portion of the elastic sheet in the radial direction and the central axis of the inner cylindrical body is greater than the distance between the outer end portion of the elastic pad in the radial direction and the central axis of the inner cylinder body by 0.1 mm to 0.5 mm, preferably 0.3 mm.

According to an embodiment of the present disclosure, the elastic pad and the elastic sheet are staggered from each other in the circumferential direction.

According to an embodiment of the present disclosure, the elastic sheet has an extension length in the circumferential direction that is greater than an extension length of the elastic pad in the circumferential direction.

According to an embodiment of the present disclosure, an end of the elastic sheet is bendable to elastically contact the inner wall of the outer cylinder body when the inner cylinder body is assembled in the outer cylinder body.

According to an embodiment of the present disclosure, the elastic pad comprises a thin-walled portion formed on the side wall of the inner cylinder body and a pad portion protruding on the thin-walled portion, the thin-walled portion surrounds the pad portion, the thin-walled portion has a thickness smaller than a thickness of the side wall of the adjacent inner cylinder body, and the pad portion has a thickness greater than the thickness of the side wall of the adjacent inner cylinder body.

According to an embodiment of the present disclosure, a notch portion is formed in the thin-walled portion on upper and lower sides of the pad portion.

According to an embodiment of the present disclosure, the thickness of the pad portion is greater than the thickness of the side wall of the inner cylinder body by 0.2 mm to 0.8 mm, preferably 0.5 mm.

According to an embodiment of the present disclosure, the elastic pad has a generally circular or elliptical shape.

According to an embodiment of the present disclosure, the number of the elastic sheets is two, and the two elastic sheets are radially symmetrically arranged.

According to an embodiment of the present disclosure, the number of the elastic pads is two pairs, and the two pairs of elastic pads are radially symmetrically arranged.

According to an embodiment of the present disclosure, the elastic pad and the elastic sheet are both formed on a lower portion of the inner cylinder body and located below the longitudinal through hole and the spiral groove.

According to an embodiment of the present disclosure, the container further comprises a stopper disposed on the inner cylinder body or the outer cylinder body to restrict an axial movement between the inner cylinder body and the outer cylinder body.

According to an embodiment of the present disclosure, the rod-shaped material is a lipstick or a lip balm.

According to the embodiments of the present disclosure, at least one elastic pad and at least one elastic sheet are formed between the inner cylinder body and the outer cylinder body. The elastic pad and the elastic sheet can cooperate to jointly control the torque of the relative rotation of the inner cylinder body and the outer cylinder body to ensure smooth rotation of the inner cylinder body relative to the outer cylinder body, thereby improving the user experience.

DETAILED DESCRIPTION

Figure 1:
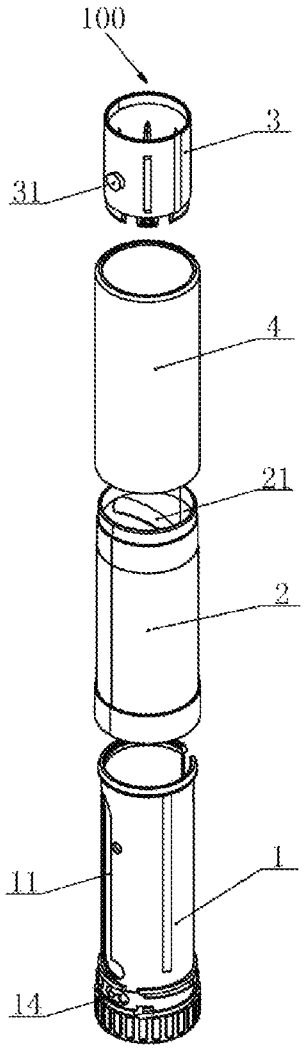
FIG. 1 illustrates a partially exploded perspective view of a lipstick tube in accordance with an exemplary embodiment of the present disclosure.

In order to make the purposes, technical solutions, and advantages of the present disclosure more clear, the embodiments of the present disclosure will be described in detail below with reference to the drawings. It should be understood that the embodiments disclosed in the drawings are for illustrative purposes only but not to be construed as limiting the present disclosure. In the description, the same or similar reference numbers indicate the same or similar components or members. For clarity, the drawings are not necessarily drawn in proportion, and some known components and structures may be omitted in the drawings.

Unless otherwise defined, technical terms or scientific terms used in the present disclosure shall be of the general meaning understood by the ordinary skilled in the art. The words "first," "second" and the like used in the present disclosure do not denote any order, quantity or importance, but are only used to distinguish different components. The words "comprising," "including" and the like indicate that the element or item preceding the word contains the elements or items listed following the word and the equivalents, but do not exclude other elements or items. The words "connected," "coupled" and the like are not limited to physical or mechanical connections, but may include electrical connections, whether direct or indirect. The words "upper", "lower", "left", "right", "top" or "bottom" and the like are only used to indicate relative positional relationship, and when the absolute position of the object described is changed, the relative positional relationship may be changed accordingly. When an element such as a layer, a film, a region or a substrate is referred to be located "above" or "below" another element, the element can be "directly" located "above" or "below" the another element, or there may be an intermediate element.

According to the general concept of the embodiments of the present disclosure, the present disclosure provides a container for a rod-shaped material, comprising: an inner cylinder body having at least one longitudinal through hole formed in a side wall of the inner cylinder body; an outer cylinder body having at least one spiral groove formed on an inner wall of the outer cylinder body; and a support cylinder body for supporting the rod-shaped material, an outer wall of the support cylinder body having at least one convex column; wherein the inner cylinder body is accommodated in the outer cylinder body and rotatable relative to the outer cylinder body, the support cylinder body is accommodated in the inner cylinder body, the convex column is inserted into the longitudinal through hole and the spiral groove, such that the convex column moves along the spiral groove when the inner cylinder body rotates relative to the outer cylinder body; wherein at least one elastic pad and at least one elastic sheet are formed between the inner cylinder body and the outer cylinder body, the elastic pad is floatingly arranged in a radial direction of the inner cylinder body or the outer cylinder body, and the elastic sheet is arranged in a circumferential direction of the inner cylinder body or the outer cylinder body.

According to the embodiments of the present disclosure, at least one elastic pad and at least one elastic sheet are formed between the inner cylinder body and the outer cylinder body. The elastic pad and the elastic sheet can cooperate to jointly control the torque of the relative rotation of the inner cylinder body and the outer cylinder body to ensure smooth rotation of the inner cylinder body relative to the outer cylinder body, thereby improving the user experience. For example, when one of the elastic pad and the elastic sheet fails, the other can still function to control the torque. Moreover, the elastic pad and the elastic sheet can mutually share the torque, and the durability of the elastic pad and the elastic sheet may be improved.

By taking a lipstick tube as an example, the structure of the container for a rod-shaped material according to the embodiments of the present disclosure will be described below. Those skilled in the art should appreciate that the container in accordance with the concept of the present disclosure can be used for any rod-shaped material, such as other applicable rod-shaped cosmetics, skin care products, or for other applications. The present disclosure provides no limitations on this.

Figure 2:
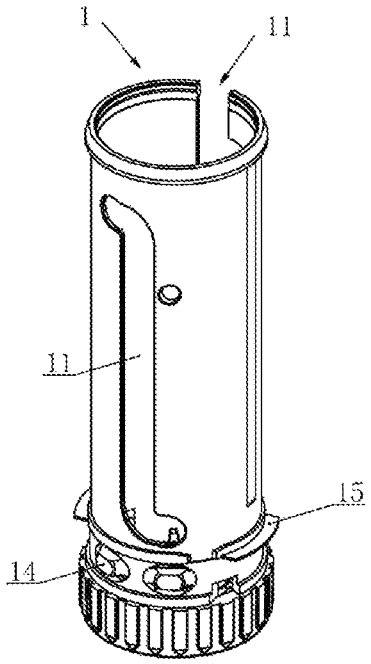
FIG. 2 illustrates a perspective view of an inner cylinder body in FIG. 1.
Figure 3:
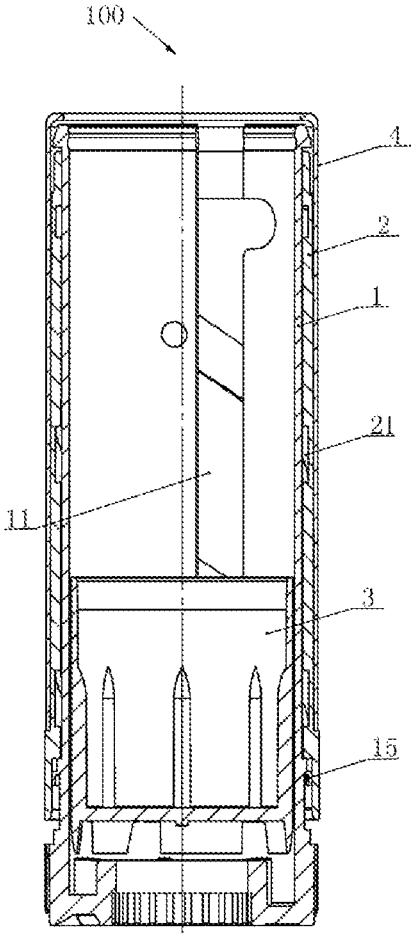
FIG. 3 illustrates a cross-sectional view of an assembled state of the lipstick tube shown in FIG. 1.
Figure 4:
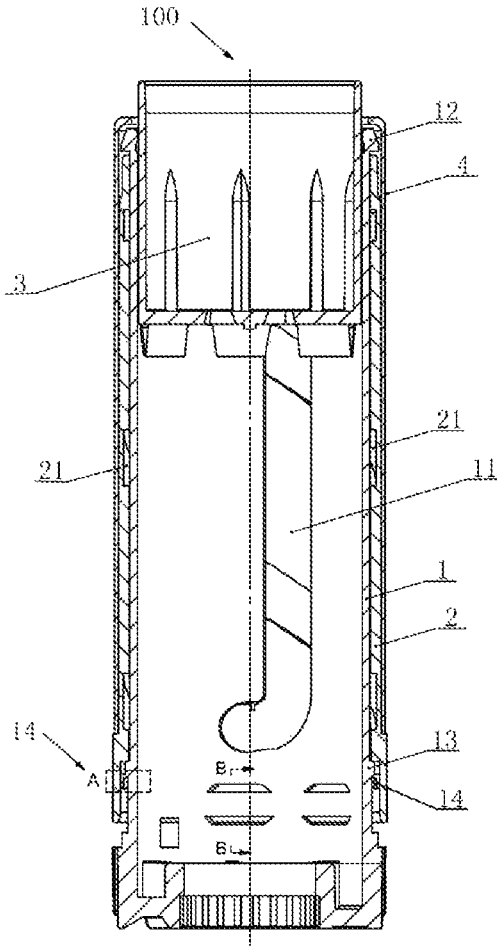
FIG. 4 illustrates another cross-sectional view of the assembled state of the lipstick tube shown in FIG. 1.

FIG. 1 illustrates a partially exploded perspective view of a lipstick tube 100 in accordance with an exemplary embodiment of the present disclosure. FIG. 2 illustrates a perspective view of an inner cylinder body 1 of the lipstick tube 100 in FIG. 1. FIG. 3 illustrates a cross-sectional view of the assembled state of the lipstick tube shown in FIG. 1. FIG. 4 illustrates another cross-sectional view of the assembled state of the lipstick tube shown in FIG. 1.

As illustrated in FIGS. 1-4, the lipstick tube 100 comprises an inner cylinder body 1, an outer cylinder body 2 and a support cylinder body 3. The inner cylinder body 1 is accommodated in the outer cylinder body 2 and rotatable relative to the outer cylinder body 2. The support cylinder body 3 is accommodated in the inner cylinder body 1. The support cylinder body 3 is configured to support the lipstick and can slide up and down in the inner cylinder body 1. The inner cylinder body 1, the outer cylinder body 2 and the support cylinder body 3 each can be molded from a thermoplastic elastomer material such as polypropylene. Optionally, the lipstick tube 100 may further comprise a decorative outer casing 4 as well as structure such as a protective cover, a decorative base and the like (not shown).

Top and bottom of the inner cylinder body 1 are respectively provided with step portions 12 and 13 projecting from the side walls thereof as stoppers to restrict the axial movement between the inner cylinder body 1 and the outer cylinder body 2. It should be understood by those skilled in the art that the form of the stopper is not limited to the step portion, and may also be other forms as long as the axial movement between the inner cylinder body 1 and the outer cylinder body 2 can be restricted. Further, the stopper portion may be formed on the outer cylinder body 2 instead of the inner cylinder body 1, which is not limited in the present disclosure.

Two radially symmetrical longitudinal through holes 11 are formed on the side wall of the inner cylinder body 1. At least one spiral groove 21 is formed in the inner wall of the outer cylinder body 2. The outer wall of the support cylinder body 3 has at least one convex column 31 thereon. When the lipstick tube 100 is in the assembled state, the convex column 31 of the support cylinder body 3 passes through the longitudinal through hole 11 of the inner cylinder body 1 and is inserted into the spiral groove 21 of the outer cylinder body 2. Thus, when the inner cylinder body 1 rotates relative to the outer cylinder body 2, the convex column 31 can move along the spiral groove 21, so that the support cylinder body 3 slides in the inner cylinder body 1. According to the rotational direction of the relative rotation of the inner cylinder body 1 and the outer cylinder body 2, the support cylinder body 3 carries the lipstick to rise or fall in the lipstick tube 100. FIG. 3 illustrates a state in which the support cylinder body 3 is located at the bottom of the lipstick tube 100. FIG. 4 illustrates a state in which the support cylinder body 3 is located at the top of the lipstick tube 100. It is to be understood by those skilled in the art that the number of the longitudinal through holes of the inner cylinder body and the number of the spiral grooves of the outer cylinder body may be plural, and the number of the convex columns may also be plural, which is not limited in the present disclosure.

As shown in FIGS. 2, 5, 5A and 5B, an elastic pad 14 and an elastic sheet 15 are formed on the outer wall of the inner cylinder body 1 near the bottom. To avoid affecting the relative rotation of the inner and outer cylinder bodies, the elastic pad 14 and the elastic sheet 15 are located below the longitudinal through hole 11 and the spiral groove 21. The elastic pad 14 is floatingly arranged in a radial direction of the inner cylinder body 1, and the elastic sheet 15 is arranged in a circumferential direction of the inner cylinder body 1. According to an embodiment, the elastic pad 14 and the elastic sheet 15 are integrally formed on the outer wall of the inner cylinder body 1. When the inner cylinder body 1 rotates relative to the outer cylinder body 2, the elastic pad 14 and the elastic sheet 15 jointly control the torque of the relative rotation of the inner cylinder body 1 and the outer cylinder body 2 to ensure smooth rotation of the inner cylinder body 1 relative to the outer cylinder body 2, thereby improving the user experience. For example, when one of the elastic pad and the elastic sheet fails, the other can still function to control the torque. Moreover, the elastic pad and the elastic sheet can mutually share the torque, and the durability of the elastic pad and the elastic sheet can be improved.

Especially, since the elastic sheet 15 is very thin, when the external torque is excessively large, the elastic sheet 15 is extremely easily damaged if there is no elastic pad 14 to share the torque, which may result in control failure. According to the embodiments of the present disclosure, the elastic pad 14 and the elastic sheet 15 mutually share the torque, so the elastic sheet 15 is not easily damaged. On the other hand, without the elastic sheet 15, the elastic pad 14 may not provide sufficient friction force due to the floating arrangement, which may lead to the failure of torque control when the inner cylinder body 1 rotates relative to the outer cylinder body 2. However, according to the embodiments of the present invention, the elastic pad 14 and the elastic piece 15 cooperate to jointly control the torque of the relative rotation of the inner cylinder body 1 and the outer cylinder body 2 to ensure the stable rotation of the inner cylinder body 1 relative to the outer cylinder body 2, thereby improving the user experience.

According to a specific embodiment, the elastic sheet 15 is a wing-shaped thin sheet that protrudes from the outer wall of the inner cylinder body 1. The elastic pad 14 is a radial slider formed in the side wall of the inner cylinder body 1 and has an outer contour of a substantially circular or elliptical shape. The elastic sheet 15 is located above the elastic pad 14, and the elastic pad 14 and the elastic sheet 15 are staggered from each other in the circumferential direction of the inner cylinder body 1, so that a uniform torque is obtained in the circumferential direction when the inner cylinder body 1 and the outer cylinder body 2 rotate relative to each other.

Figure 4A:
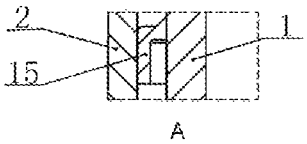
FIG. 4A illustrates an enlarged view of portion A in FIG. 4.
Figure 4B:
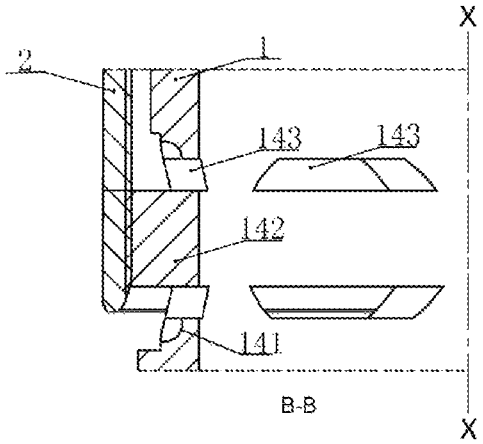
FIG. 4B illustrates a partial enlarged cross-sectional view along line B-B in FIG. 4.
Figure 5:
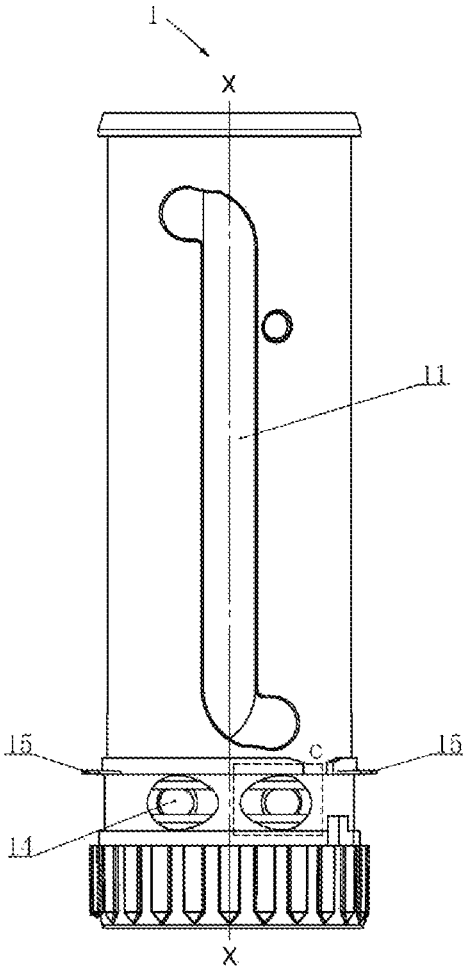
FIG. 5 illustrates a front view of the inner cylinder body in FIG. 1.
Figure 5A:
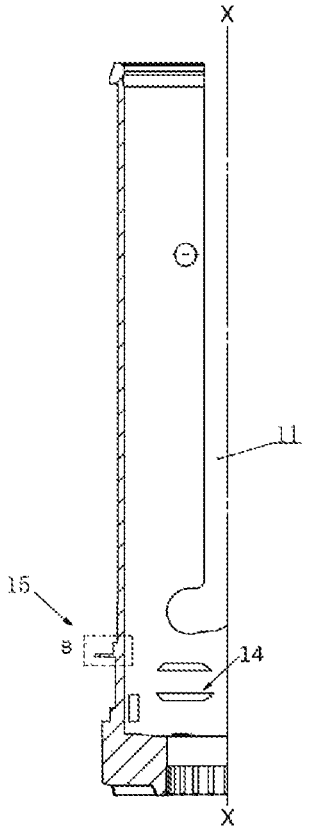
FIG. 5A illustrates an axial half cross-sectional view of the inner cylinder body in FIG. 5.
Figure 5B:
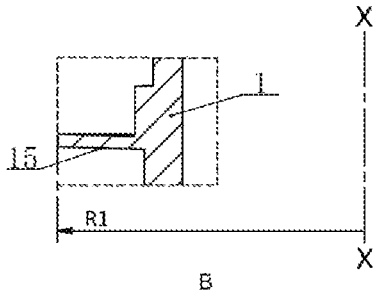
FIG. 5B illustrates an enlarged view of portion B in FIG. 5A.
Figure 5C:
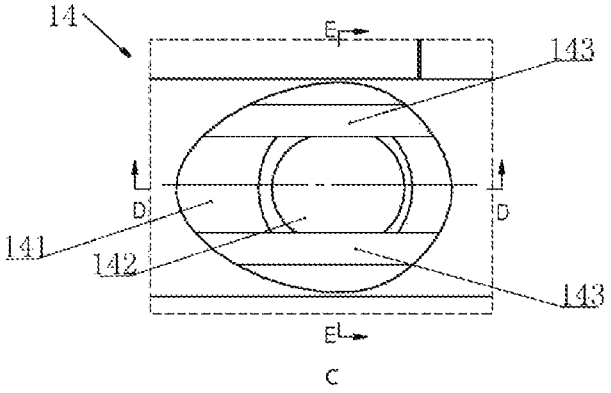
FIG. 5C illustrates an enlarged view of portion C in FIG. 5.
Figure 5D:
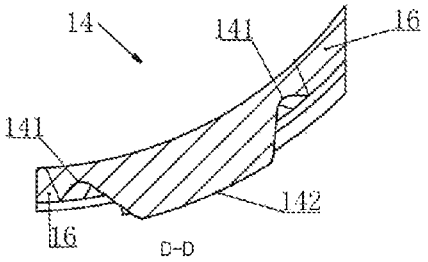
FIG. 5D illustrates an enlarged cross-sectional view along line D-D in FIG. 5C.
Figure 5E:
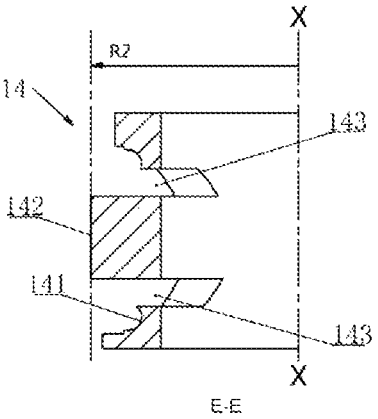
FIG. 5E illustrates an enlarged cross-sectional view along line E-E in FIG. 5C.

According to an embodiment, the extension length of the elastic sheet 15 in the circumferential direction may be greater than the extension length of the elastic pad 14 in the circumferential direction. The friction force between the elastic sheet 15 and the inner wall of the outer cylinder body 2 can be adjusted by adjusting the extension length of the elastic sheet 15 in the circumferential direction. The elastic sheet 15 is very thin, for example, the elastic sheet 15 has a thickness of 0.1 mm to 0.5 mm, preferably 0.2 mm. When the inner cylinder body 1 is assembled in the outer cylinder body 2, an end of the elastic sheet 15 is bendable to elastically contact the inner wall of the outer cylinder body, as shown in FIGS. 3, 4 and 4A. In order to increase the frictional force between the elastic sheet 15 and the inner wall of the outer cylinder body 2, the extension length of the elastic sheet 15 in the circumferential direction may be selected from the range of 4 mm to 10 mm, preferably 6 mm. If the radial dimension of the elastic sheet 15 is too large, the elastic sheet 15 will be insufficient to support the gap between the inner and outer cylinder bodies, resulting in shaking of the inner and outer cylinder bodies. And if the radial dimension of the elastic sheet 15 is too small, the friction braking effect will not be achieved. The radial dimension of the elastic sheet 15 may be selected from the range of 0.8 mm to 1.5 mm, preferably 1.2 mm.

According to an embodiment, the number of the elastic sheets 15 may be two, and the two elastic sheets 15 are symmetrically arranged in the radial direction of the inner cylinder body 1. The number of the elastic pads 14 may be two pairs, and the two pairs of elastic pads 14 are symmetrically arranged in the radial direction of the inner cylinder body 1. In this way, a uniform torque can be ensured in the circumferential direction of the inner cylinder body 1.

Although the figures show that the elastic pad 14 and the elastic sheet 15 are both formed on the outer wall of the inner cylinder body 1, it will be understood by those skilled in the art that the elastic pad 14 and the elastic sheet 15 may also be formed on the inner wall of the outer cylinder body 2. Alternatively, one of the elastic pad 14 and the elastic sheet 15 is formed on the outer wall of the inner cylinder body 1, and the other is formed on the inner wall of the outer cylinder body 2. The present disclosure provides no limitation on this as long as the elastic pad 14 and the elastic sheet 15 are formed between the inner cylinder body 1 and the outer cylinder body 2. In addition, although the figures show that the number of the elastic pads 14 is two pairs, and the number of the elastic sheets 15 is two, the present disclosure is not limited thereto. The elastic pad 14 and the elastic piece 15 may have any number.

As shown in FIGS. 2, 4, 4B, 5, 5C-5E, the elastic pad 14 comprises a thin-walled portion 141 formed on the side wall of the inner cylinder body 1, and a pad portion 142 protruding on the thin-walled portion 141, where the thin-walled portion 141 surrounds the pad portion 142. The thin-walled portion 141 has a thickness that is smaller than the thickness of the side wall 16 of the adjacent inner cylinder body 1, and the pad portion 142 has a thickness that is greater than the thickness of the side wall 16 of the adjacent inner cylinder body 1. According to this configuration, the elastic pad 14 becomes a radial slider formed in the side wall of the inner cylinder body 1. When the inner cylinder body 1 rotates relative to the outer cylinder body 2, the outer cylinder body 2 presses the pad portion 142 in the radial direction, and the elastic pad 14 may be elastically abutted against the inner wall of the outer cylinder body 2 to control the torque when the inner and outer cylinder bodies rotate relative to each other.

According to an example, the side wall 16 of the inner cylinder body 1 has a thickness of 0.6 mm, and the thickness of the wall portion 141 is smaller than the thickness of the side wall 16 of the adjacent inner cylinder body 1 by 0.2 mm to 0.4 mm, preferably by 0.3 mm. The thickness of the pad portion 142 is greater than the thickness of the side wall 16 of the inner cylinder body 1 by 0.2 mm to 0.8 mm, preferably by 0.5 mm. By properly selecting the thickness of the thin-walled portion 141 and the pad portion 142, it can be ensured that the elastic pad 14 has appropriate elasticity and provides appropriate friction braking force when the inner and outer cylinder bodies rotate relative to each other, so as to avoid the unsmooth rotation caused by too large or too small torque which affects the user experience.

According to an exemplary embodiment, as shown in FIGS. 2, 4, 4B, 5, 5C-5E, and especially as shown in FIGS. 4, 4B, 5C, 5E, a notch portion 143 is formed in the thin-walled portion 141 on the upper and lower sides of the pad portion 142. By the notch portion 143, the elasticity of the pad portion 142 can be further improved, and the range in which the elastic pad 14 is radially floated can be increased.

According to a specific embodiment, the distance R1 between the outer end portion of the elastic sheet 15 in the radial direction and the central axis X-X of the inner cylinder body 1 is greater than the distance R2 between the outer end portion of the elastic pad 14 in the radial direction and the center X-X of the inner cylinder body. According to this arrangement, the elastic sheet 15 can serve as a main torque control member to first contact the inner wall of the outer cylinder body 2, and the elastic pad 14 can serve as a secondary torque control member for auxiliary control. Specifically, the elastic sheet 15 is in direct contact with the inner wall of the outer cylinder body 2 to provide a larger friction braking effect, and the elastic pad 14 is floatingly arranged to have a smaller friction braking effect. Thus, when the inner cylinder body 1 rotates relative to the outer cylinder body 2, a predetermined torque of an appropriate size can be provided as needed.

Especially, since the elastic sheet 15 is very thin, when the external torque is excessively large, the elastic sheet 15 is extremely easily damaged if there is no elastic pad 14 to share the torque, which may result in control failure. According to the above embodiments, when the too large torque causes excessive deformation of the elastic sheet 15, the elastic pad 14 can share the torque to prevent the elastic sheet 15 from being damaged.

The embodiments of the present disclosure have been described by way of example. However, those skilled in the art will recognize that various modifications and changes can be made to the embodiments of the present disclosure without departing from the inventive concept of the present disclosure. The embodiments may be combined with each other and partially replaced without causing a conflict. All such modifications and variations are intended to fall within the scope of the present disclosure. Therefore, the scope of protection of the present disclosure should be determined by the scope of protection defined by the claims.

What is claimed is:

1. A container for a rod-shaped material, comprising:

an inner cylinder body having at least one longitudinal through hole formed in a side wall of the inner cylinder body;

an outer cylinder body having at least one spiral groove formed on an inner wall of the outer cylinder body; and a support cylinder body for supporting the rod-shaped material, an outer wall of the support cylinder body having at least one convex column;

wherein the inner cylinder body is accommodated in the outer cylinder body and rotatable relative to the outer cylinder body, the support cylinder body is accommodated in the inner cylinder body, the convex column is inserted into the longitudinal through hole and the spiral groove, such that the convex column moves along the spiral groove when the inner cylinder body rotates relative to the outer cylinder body;

wherein at least one elastic pad and at least one elastic sheet are formed between the inner cylinder body and the outer cylinder body, wherein the elastic pad comprises a thin-walled portion formed on the side wall of the inner cylinder body and a pad portion protruding on the thin-walled portion with a notch portion being formed in the thin-walled portion on upper and lower sides of the pad portion the thin-walled portion has a thickness smaller than a thickness of the side wall of the adjacent inner cylinder body, and wherein the elastic pad is floatingly arranged in a radial direction of the inner cylinder body or the outer cylinder body, wherein the elastic sheet is arranged in a circumferential direction of the inner cylinder body or the outer cylinder body, and wherein the elastic pad and the elastic sheet are staggered from each other in the circumferential direction.

2. The container according to claim 1, wherein a distance between an outer end portion of the elastic sheet in the radial direction and a central axis of the inner cylinder body is greater than a distance between an outer end portion of the elastic pad in the radial direction and the central axis of the inner cylinder body.

3. The container according to claim 2, wherein the distance between the outer end portion of the elastic sheet in the radial direction and the central axis of the inner cylindrical body is greater than the distance between the outer end portion of the elastic pad in the radial direction and the central axis of the inner cylinder body by 0.1 mm to 0.5 mm.

4. The container according to claim 1, wherein the elastic sheet has an extension length in the circumferential direction that is greater than an extension length of the elastic pad in the circumferential direction.

5. The container according to claim 1, wherein an end of the elastic sheet is bendable to elastically contact the inner wall of the outer cylinder body when the inner cylinder body is assembled in the outer cylinder body.

6. The container according to claim 1, wherein the thin-walled portion surrounds the pad portion, and the pad portion has a thickness greater than the thickness of the side wall of the adjacent inner cylinder body.

7. The container according to claim 6, wherein the thickness of the pad portion is greater than the thickness of the side wall of the inner cylinder body by 0.2 mm to 0.8 mm.

8. The container according to claim 6, wherein the elastic pad has a generally circular or elliptical shape.

9. The container according to claim 1, wherein the number of the elastic sheets is two, and the two elastic sheets are radially symmetrically arranged.

10. The container according to claim 1, wherein the number of the elastic pads is two pairs, and the two pairs of elastic pads are radially symmetrically arranged.

11. The container according to claim 1, wherein the elastic pad and the elastic sheet are both formed on a lower portion of the inner cylinder body and located below the longitudinal through hole and the spiral groove.

12. The container according to claim 1, further comprising a stopper disposed on the inner cylinder body or the outer cylinder body to restrict an axial movement between the inner cylinder body and the outer cylinder body.

13. The container according to claim 1, wherein the rod-shaped material is a lipstick or a lip balm.

14. The container according to claim 1, wherein the elastic pad and the elastic sheet are both formed on an outer wall of the inner cylinder body.

* * * * *